US007007441B2

(12) United States Patent
Benedetti et al.

(10) Patent No.: US 7,007,441 B2
(45) Date of Patent: Mar. 7, 2006

(54) UNIT FOR STERILIZING WEB-FED MATERIAL ON A MACHINE FOR PACKAGING POURABLE FOOD PRODUCTS

(75) Inventors: Paolo Benedetti, Modena (IT); Filippo Ferrarini, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 6 days.

(21) Appl. No.: 10/502,352

(22) PCT Filed: Feb. 7, 2003

(86) PCT No.: PCT/EP03/01230

§ 371 (c)(1),
(2), (4) Date: Jul. 23, 2004

(87) PCT Pub. No.: WO03/066443

PCT Pub. Date: Aug. 14, 2003

(65) Prior Publication Data

US 2005/0126117 A1 Jun. 16, 2005

(30) Foreign Application Priority Data

Feb. 8, 2002 (EP) ..... 02425063

(51) Int. Cl.
*B65B 55/10* (2006.01)

(52) U.S. Cl. ..... 53/167; 53/551

(58) Field of Classification Search ..... 53/167, 53/550, 551, 425, 426, 450, 451
See application file for complete search history.

(56) References Cited

U.S. PATENT DOCUMENTS

| | | | | |
|---|---|---|---|---|
| 3,086,336 | A * | 4/1963 | Rausing et al. | 53/167 |
| 4,537,007 | A | 8/1985 | Lattanzi | |
| 4,783,947 | A * | 11/1988 | Posey et al. | 53/167 |
| 5,173,259 | A * | 12/1992 | Bordini | 422/28 |
| 6,442,915 | B1 * | 9/2002 | Kurth et al. | 53/426 |
| 6,638,476 | B1 * | 10/2003 | Elias et al. | 422/28 |
| 6,658,818 | B1 * | 12/2003 | Kurth et al. | 53/426 |
| 2005/0076612 | A1 * | 4/2005 | Andersson et al. | 53/167 |

FOREIGN PATENT DOCUMENTS

| | | | |
|---|---|---|---|
| EP | 1050467 | A | 11/2000 |
| JP | 01037325 | A | 2/1989 |
| JP | 10016925 | A | 1/1998 |

* cited by examiner

*Primary Examiner*—Stephen F Gerrity
(74) *Attorney, Agent, or Firm*—Buchanan Ingersoll PC

(57) ABSTRACT

A unit for sterilizing a web (2) of packaging material on a machine (1) for packaging pourable food products, the unit having a bath (7) containing a sterilizing agent, in which the web (2) is fed continuously; a process chamber (8) connected to an outlet (12) of the bath (7), and housing drying means (17) for removing residual sterilizing agent from the web (2); an aseptic chamber (25) communicating with the process chamber (8) via an opening (27) for passage of the web (2), and in which the web (2) is folded and sealed longitudinally to form a tube (29) which is filled continuously with the product for packaging; and an air processing circuit (24) for controlling process conditions; the circuit (24) draws air from the process chamber (8) through an orifice (54), the opening of which is adjustable, during operation of the machine, by a shutter (55) to maintain a pressure value greater than a predetermined minimum value in the aseptic chamber (25).

11 Claims, 2 Drawing Sheets

UNIT FOR STERILIZING WEB-FED MATERIAL ON A MACHINE FOR PACKAGING POURABLE FOOD PRODUCTS

TECHNICAL FIELD

The present invention relates to a unit for sterilizing web-fed material on a machine for packaging pourable food products.

BACKGROUND ART

Machines for packaging pourable food products—such as fruit juice, wine, tomato sauce, pasteurized or long-storage (UHT) milk, etc.—are known, on which packages are formed from a continuous tube of packaging material defined by a longitudinally sealed web.

The packaging material has a multilayer structure comprising a layer of paper material covered on both sides with layers of heat-seal material, e.g. polyethylene. And, in the case of aseptic packages for long-storage products, e.g. UHT milk, the packaging material comprises a layer of barrier material defined, for example, by aluminium foil, and which is superimposed on a layer of heat-seal plastic material, and is in turn covered with another layer of heat-seal plastic material eventually defining the inner face of the package and therefore contacting the food product.

To produce aseptic packages, the web of packaging material is unwound off a reel and fed through a sterilizing unit, in which it is sterilized, for example, by immersion in a bath of liquid sterilizing agent, such as a concentrated hydrogen peroxide and water solution.

More specifically, the sterilizing unit comprises a bath filled, in use, with the sterilizing agent, into which the web is fed continuously. The bath conveniently comprises two vertical parallel branches connected at the bottom to define a U-shaped path long enough to ensure the packaging material is treated for a sufficient length of time. For effective treatment in a relatively short time, and therefore to reduce the size of the sterilizing chamber, the sterilizing agent must be maintained at a high temperature, e.g. around 70° C.

The sterilizing unit also comprises a process chamber located over the bath, and in which the web of packaging material is dried; and an aseptic chamber, in which the web is folded and sealed longitudinally to form a tube, which is then filled continuously with the product for packaging.

More specifically, in the process chamber, the web is processed to remove any residual sterilizing agent, the acceptable amount of which in the packaged product is governed by strict standards (the maximum permissible amount being in the region of a few fractions of apart per million).

Such processing normally comprises mechanical removal of any drops on the material, followed by air drying.

The drops may be removed, for example, by feeding the material through a pair of wringing rollers conveniently located close to the process chamber inlet, and downstream from which the material is still covered with a film of sterilizing agent, but has no macroscopic drops.

Drying may be performed by means of air knives facing opposite faces of the material, supplied with air from the sterile environment, e.g. by means of a recirculating conduit as described in EP-A-1 050 467, and which provide for removing residual traces of sterilizing agent by evaporation.

Alternatively, complete drying may be achieved in a low drying channel, through which the process chamber communicates with the aseptic chamber.

Before leaving the aseptic chamber, the web is folded into a cylinder and sealed longitudinally to form, in known manner, a continuous, longitudinally sealed, vertical tube. In other words, the tube of packaging material forms an extension of the aseptic chamber, and is filled continuously with the pourable food product and then fed to a forming and (transverse) sealing unit for forming the individual packages, and on which the tube is gripped and sealed transversely between pairs of jaws to form aseptic pillow packs.

The pillow packs are separated by cutting the seals between the packs, and are then fed to a final folding station where they are folded mechanically into the finished shape.

Packaging machines of the above type are used widely and satisfactorily in a wide range of food industries for producing aseptic packages from web-fed packaging material. Performance of the sterilizing unit, in particular, ensures ample conformance with standards governing sterility of the packages.

A need for further improvement, however, is felt within the industry itself, particularly as regards pressure control in the sterilizing unit.

In known machines, the pressure and temperature conditions in the process and aseptic chambers are normally controlled by a closed air processing circuit, which draws air from the process chamber and feeds it back into the aseptic chamber.

To ensure sterility of the environment defined by the process and aseptic chambers, both chambers must be maintained at higher than atmospheric pressure, so that any leakage can only occur outwards, i.e. sterile air can leak from the machine, but no non-sterile air can leak from the outside environment into the machine. Moreover, to ensure one-way airflow from the aseptic chamber to the process chamber, at least a roughly 10 $mmH_2O$ pressure difference must be maintained between the two chambers.

In known machines, the pressure values in the aseptic and process chambers are substantially defined by design conditions, are ensured by appropriate calibrated leakage between the two chambers and between the process chamber and the outside, and are simply monitored, so that, if they are too low, e.g. due to in-service sealing defects, the machine, and therefore production, must be stopped for the necessary steps to be taken.

DISCLOSURE OF INVENTION

It is an object of the present invention to provide a unit for sterilizing packaging material, designed to eliminate the aforementioned drawback, i.e. which provides for controlling pressure in the aseptic chamber and process chamber with no stoppage in production.

According to the present invention, there is provided a sterilizing unit for sterilizing a web of packaging material on a machine for packaging pourable food products, the sterilizing unit comprising:

a bath containing a sterilizing agent, in which said web is fed continuously;

an aseptic environment comprising a process chamber connected to an outlet of said bath and housing drying means for removing residual sterilizing agent from said web; and an aseptic chamber communicating with said process chamber via an opening for the passage of said web, and in which said web is folded and sealed longitudinally to form a tube which is filled continuously with the product for packaging; and an air processing circuit for controlling the process conditions in said aseptic environment, and comprising suction means for drawing air from said process chamber, air processing means, and means for feeding processed air into said aseptic chamber;

characterized by comprising valve means interposed between said process chamber and said suction means of said air processing circuit, and which can be activated during operation of said machine to control the pressure conditions in said aseptic environment.

In a preferred embodiment of the present invention, the sterilizing unit comprises a transition chamber communicating with the inlet of the bath and with the suction means; and the valve means comprise an orifice interposed between the process chamber and the transition chamber, and a closing member which is movable to adjust the opening of the orifice between the two chambers, and so adjust the pressure in the aseptic environment during production.

Preferably, the closing member is movable between an open position, and a fully-closed position isolating the process chamber from the outside environment, so that, during production stoppages, air can be drawn through the bath, which, during stoppages, is empty. This therefore provides for ventilating and cooling the packaging material, thus reducing impregnation of the edges of the web with sterilizing agent when production is started up again.

A barrier is provided between the process chamber and aseptic chamber to ensure a pressure difference between the two chambers, and defines, between the chambers, an opening through which the packaging material is fed.

According to a further preferred characteristic of the present invention, said opening is asymmetrical with respect to the traveling plane of the packaging material, i.e. is higher on the side facing one of the two faces of the material, and is preferably higher on the underside.

As such, the sterilizing unit can also be used for processing packaging material fitted with opening devices, which are fed through the higher side of the opening, while the other, lower, side ensures a sufficient pressure drop between the two chambers.

Even more preferably, the packaging material is fed horizontally through the opening, and is then guided by a roller housed in the aseptic chamber, immediately downstream from the opening; and the opening is defined, on the higher side, e.g. downwards, by a partition shaped to get close to the roller, so as to define, for the airflow from the aseptic chamber to the process chamber, a barrier ensuring the required pressure drop.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
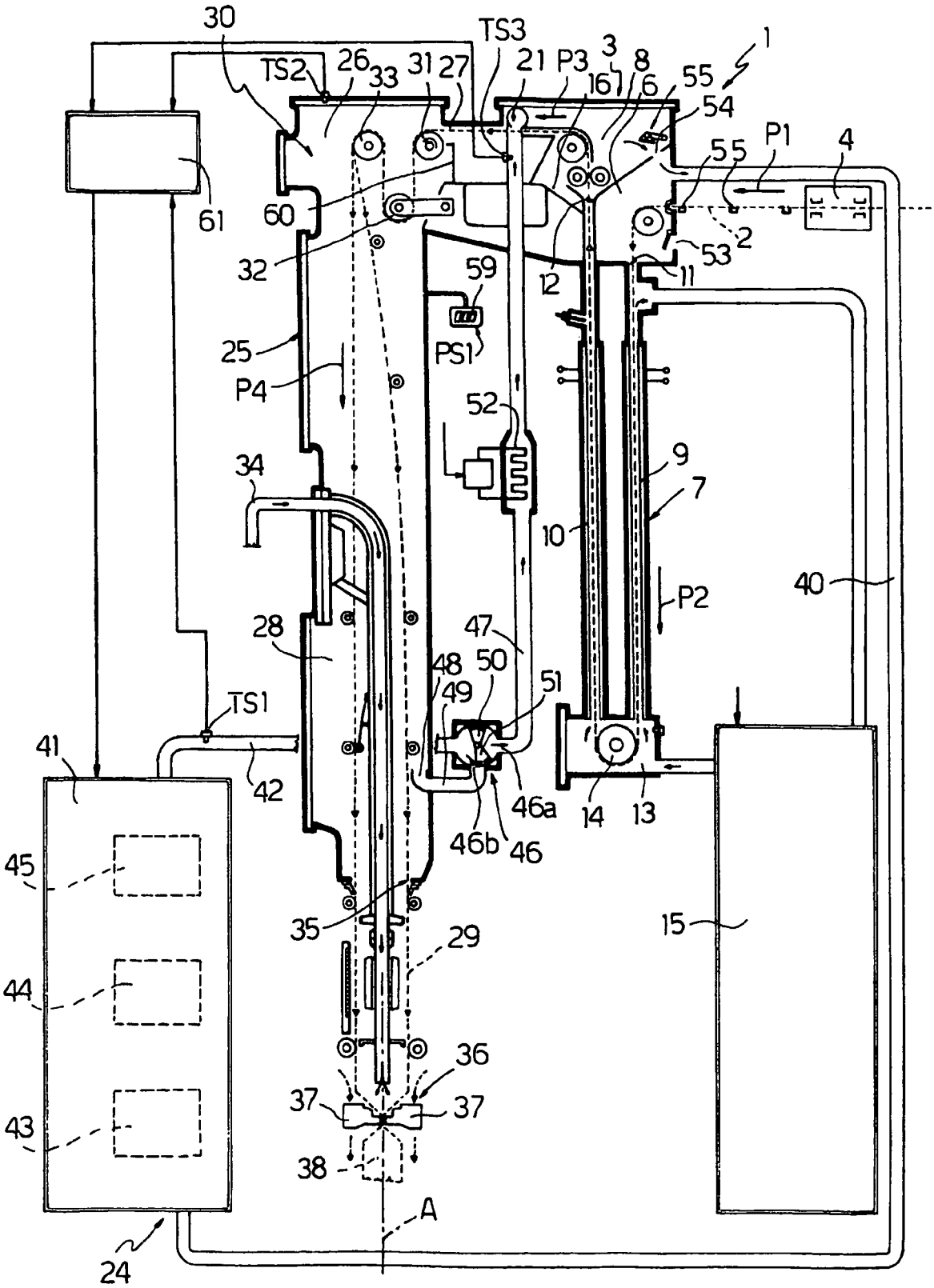
FIG. 1 shows a diagram of a machine for packaging pourable food products and featuring a sterilizing unit in accordance with the invention.

Number 1 in FIG. 1 indicates as a whole a machine for packaging pourable food products, and for continuously producing aseptic packages of a pourable food product from a web-fed packaging material 2 (hereinafter referred to simply as "web 2").

Machine 1 comprises a sterilizing unit 3 for sterilizing web 2, and to which web 2 is fed off a reel (not shown) along a path P1.

Machine 1 also comprises a unit 4, located upstream from sterilizing unit 3, for applying closable opening devices 5 to web 2, and which is conveniently defined by a known station for injection molding plastic material, and through which web 2 is fed in steps. On leaving unit 4, the web comprises a succession of equally spaced opening devices 5 (shown schematically in FIG. 1 on only a portion of web 2) projecting from one face of web 2.

Sterilizing unit 3 comprises a transition chamber 6, into which web 2 is first fed; a sterilizing bath 7 containing a liquid sterilizing agent, e.g. a solution of 30% hydrogen peroxide ($H_2O_2$) and water, through which web 2 is fed; and a process chamber 8, in which web 2 is dried as explained in detail later on.

Bath 7 is substantially defined by a U-shaped conduit, which is filled, in use, with sterilizing agent to a predetermined level, and which in turn is defined by two vertical, respectively inlet and outlet, branches 9, 10 having respective top openings 11, 12, which respectively define the web 2 inlet and outlet of bath 7, and communicate respectively with transition chamber 6 and process chamber 8. The two branches are connected at the bottom by a bottom portion 13 of bath 7, in which is housed a horizontal transmission roller 14.

Inside bath 7, web 2 therefore travels along a U-shaped path P2, the length of which is defined to ensure the packaging material is kept long enough in the sterilizing agent.

Bath 7 is connected to a known peroxide control circuit 15 (not described in detail), and is maintained, in use, at a controlled temperature, e.g. of about 70° C.

Figure 3:
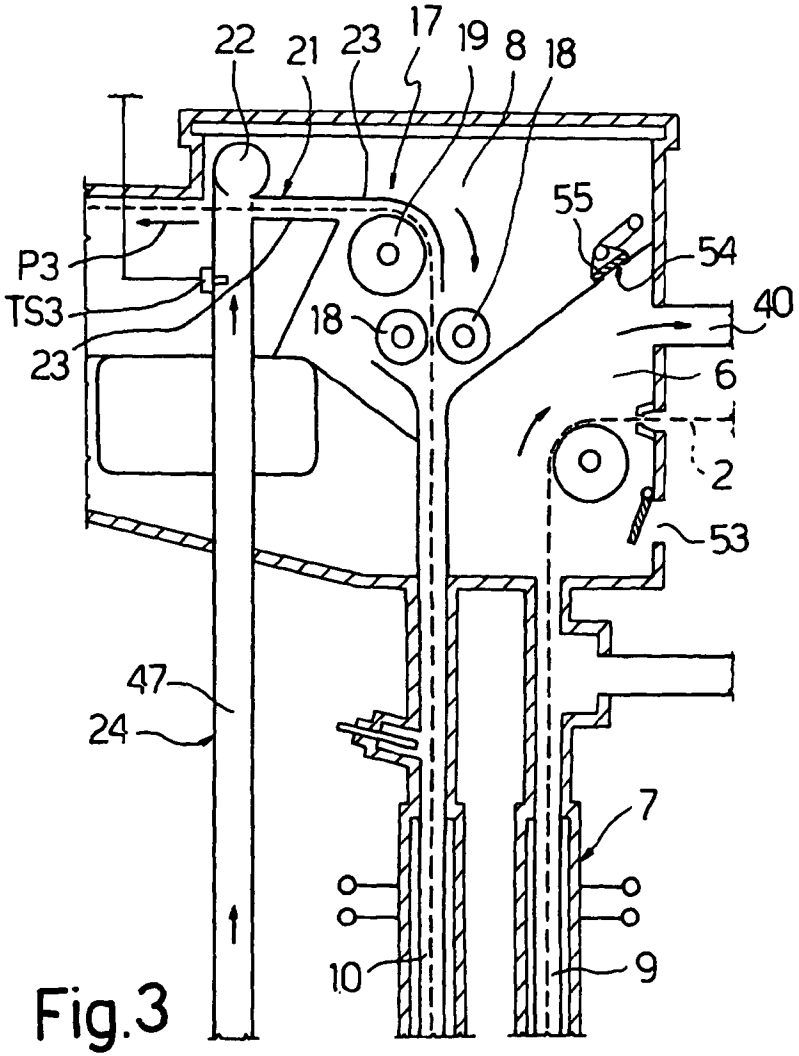
FIGS. 2 and 3 show partial schematic views of the sterilizing unit according to the invention in two different operating conditions.
Figure 2:
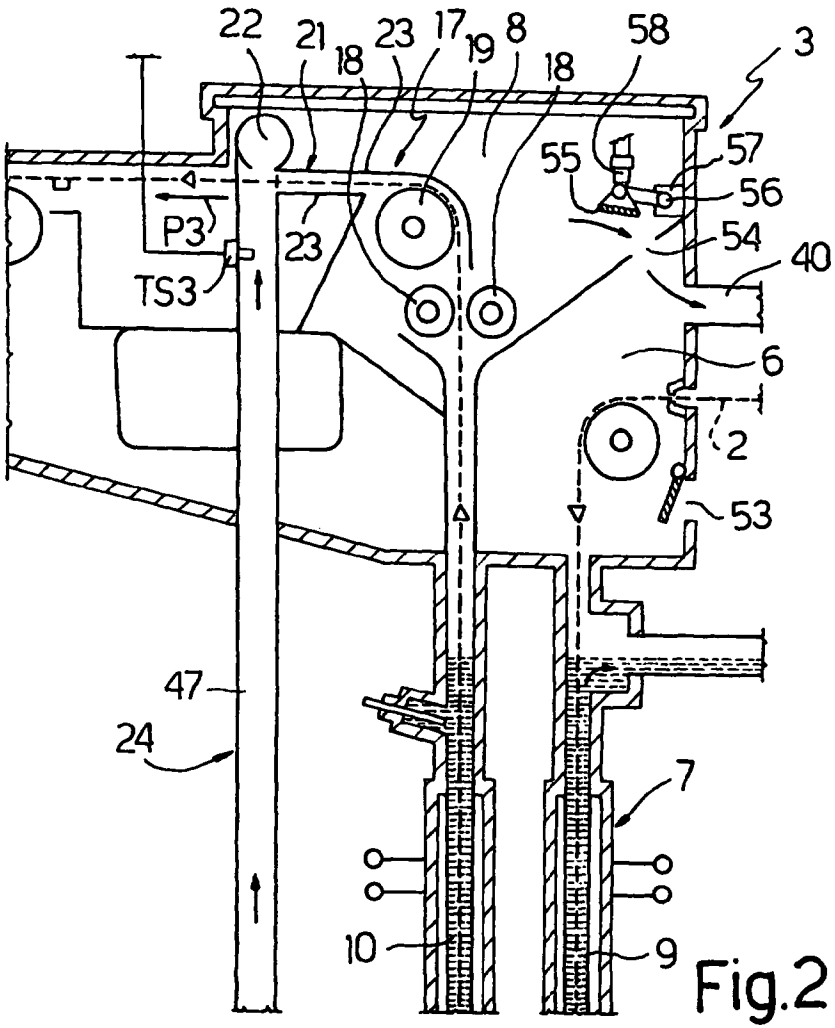

Process chamber 8 (FIGS. 2 and 3) is located over transition chamber 6, is separated from transition chamber 6 by partitions 16, and houses drying means indicated as a whole by 17 and for removing residual sterilizing agent from web 2.

Drying means 17 comprise two parallel, horizontal, idle wringing rollers 18—at least one of which is covered with a relatively soft material—located close to the inlet of process chamber 8, on opposite sides of web 2, and which cooperate with and exert pressure on respective opposite faces of web 2 to wring any drops of sterilizing agent out and back into bath 7.

Wringing rollers 18 conveniently comprise respective small-diameter intermediate portions (not shown) corresponding with the longitudinal intermediate portion of web 2, as illustrated in EP-A-1 050 468, to permit the passage of opening devices 5 without interfering with the rollers.

Downstream from wringing rollers 18, web 2 is deflected along a horizontal path P3 by a transmission roller 19.

Drying means 17 also comprise a known so-called "air knife" 21 (shown schematically), which is defined by a nozzle 22 for directing an air jet on to the face of web 2 eventually defining, in use, the inside of each package, and by two plates 23 for directing the jet, in use, substantially parallel to, but in the opposite direction to the traveling direction of, web 2.

Nozzle 22 forms part of an air processing circuit 24 described in detail later on.

Sterilizing unit 3 also comprises a vertical aseptic chamber or tower 25 having a top portion 26 communicating with process chamber 8 through an opening 27 for the passage of web 2, and an elongated bottom portion 28, in which web 2 is folded longitudinally into a cylinder and sealed longitudinally to form a continuous tube 29 of packaging material with a vertical axis A. Aseptic chamber 25 and process chamber 8 together therefore define an aseptic environment 30.

Top portion 26 houses a number of transmission and guide rollers 31, 32, 33 for guiding web 2 from horizontal path P3 to a vertical path P4 parallel to axis A of tube 29. More specifically, roller 31 is powered and located immediately downstream from opening 27; roller 32 is idle, and defines a tensioner; and roller 33 is also idle, and provides for guiding and deflecting web 2 downwards.

Tube 29, formed downstream from roller 33 in known manner not described, is filled continuously with the product by a fill conduit 34, and is fed out downwards through a bottom opening 35 in aseptic chamber 25, thus substantially forming an extension of the aseptic chamber.

Machine 1 comprises a known forming and transverse sealing unit 36 (not shown in detail), in which the tube 29 of packaging material is gripped and sealed transversely by pairs of jaws 37 to form aseptic pillow packs 38, which are eventually cut and folded in known manner to form the individual packages.

Air processing circuit 24 comprises a suction conduit 40 communicating with transition chamber 6; and a known processing unit 41 (not shown in detail) having an inlet connected to conduit 40, and an outlet connected to a conduit 42 for feeding processed air into sterilizing unit 3. Processing unit 41 conveniently comprises, in known manner, a compressor 43; purifying means 44 for removing residual sterilizing agent; and heating means 45 for heating and sterilizing the air. Conduit 42 is connected to an inlet of a three-way distributor 46 having two outlets 46*a*, 46*b* connected respectively to nozzle 22 of air knife 21 by a conduit 47, and to one or more air inlets 48 in the bottom portion of aseptic chamber 25 by a conduit 49. Distributor 46 has two shutters 50, 51, which can be operated independently, e.g. by respective servoactuators (not shown), and provide for controlling airflow along conduits 47, 49; and an electric heater 52 is housed in conduit 47.

Transition chamber 6 communicates with the outside environment through an orifice 53, which has a cover normally closed by gravity, but opened under low pressure during operation of the machine, and which defines, for circuit 24, a zero pressure reference point with respect to the outside environment.

Process chamber 8 can communicate with transition chamber 6 through an orifice 54 adjustable by means of a shutter 55.

Shutter 55 is movable—e.g. rotates integrally with a pin 56 controlled by an actuator 57—between an open position (FIG. 2) in which process chamber 8 communicates directly with transition chamber 6, and a closed position (FIG. 3) in which the two chambers are isolated. The open position is conveniently adjustable, e.g. by manually adjusting a mechanical limit stop 58 of shutter 55, even during operation of the machine.

The pressure in aseptic chamber 25 is detected by a sensor PS1 with a reading display 59.

In the event web 2 is fitted with opening devices 5, opening 27 between process chamber 8 and aseptic chamber 25 must be high enough, on the underside of web 2 from which opening devices 5 project, to permit passage of the opening devices. To prevent opening 27, the height of which is conditioned as stated above, from substantially equalizing the pressures in aseptic chamber 25 and process chamber 8, opening 27 is not symmetrical with respect to the plane of web 2, but is of minimum height upwards, and is defined downwards by a partition 60 shaped to get close to roller 31 and so define an airflow barrier and, therefore, a concentrated fall in pressure.

A programmable control unit 61 of machine 1 controls the process parameters of sterilizing unit 3 on the basis of predetermined reference values at each operating stage of the machine, and, in particular, controls heating means 45 of air processing unit 41, peroxide control circuit 15, distributor 46, heater 52, and actuator 57.

The process parameters, which may be different variables at different operating stages, are defined, for example, by the temperature of the air from unit 41, as detected by a first sensor TS1; the temperature in top portion 26 of aseptic chamber 25, as detected by a second sensor TS2; and the air temperature in conduit 47, upstream from nozzle 22, as detected by a third sensor TS3.

Operation of sterilizing unit 3 will now be described with reference to two typical operating conditions: production and short stoppages of machine 1.

During production (FIG. 2), bath 7 is full of sterilizing solution, and web 2 is fed through the bath, is dried in process chamber 8, and is sealed longitudinally into a tube in aseptic chamber 25.

In the above operating condition, distributor 46 is positioned to partly close outlet 46*b* connected to conduit 49, so as to feed a substantial portion, e.g. 40%, of flow to nozzle 22, and the rest, e.g. 60%, to aseptic chamber 25. The air temperature at the outlet of unit 41 is set to roughly 120° C., and heater 52 is controlled, on the basis of feedback from sensor TS3, to supply nozzle 22 with air at roughly 180° C.

Shutter 55 is kept open, so that process chamber 8 communicates directly with suction conduit 40 of air processing circuit 24; and opening 27 and the flow section of orifice 54, when shutter 55 is open, are sized to maintain a pressure of about 10–20 $mmH_2O$ in process chamber 8, and about 20–30 $mmH_2O$ in the aseptic chamber, with a roughly 10 $mmH_2O$ pressure drop through opening 27.

The above overpressure values with respect to the environment are sufficient to prevent entry of external agents, but low enough to prevent substantial leakage of sterilizing-agent-contaminated air from contaminating the workplace. The pressure drop through opening 27 ensures continuous one-way flow from aseptic chamber 25 to process chamber 8.

The pressure in aseptic chamber 25 during production is detected by sensor PS1.

In the event the pressure in aseptic chamber 25 falls towards a minimum safety value, e.g. due to poor sealing, this can be corrected during production by manually adjusting limit stop 58 to adjust, and in particular reduce, the flow section of orifice 54.

During short production stoppages for any routine servicing of machine 1, web 2 is stopped and bath 7 emptied.

In this condition, distributor 46 is set to fully open outlet 46*b*, and to partly close outlet 46*a*, so that flow is substantially supplied entirely to aseptic chamber 25, and a minimum portion, of about a few percent, to air knife 21.

By virtue of its high thermal inertia, aseptic chamber 25 acts as a cooler to cool the air flowing through it and through opening 27 into process chamber 8; and, since orifice 54 is closed, the cooled air travels along bath 7, which is empty, to transition chamber 6, where it is drawn out. This "ventilation" of the bath cools web 2 and reduces so-called "edge wicking"—impregnation of the edges of web 2 with sterilizing agent—when bath 7 is next filled to start up the machine. Edge wicking, which occurs at the edges of web 2 where the paper layer is exposed, can be substantially reduced by reducing the temperature of bath 7 and web 2 by ventilation as described above, and by loading the sterilizing agent at an appropriately high temperature when the machine is started up.

Clearly, changes may be made to machine 1, and in particular to sterilizing unit 3, without, however, departing from the scope of the accompanying claims.

In particular, the section of orifice 54 may be closed-loop controlled automatically to compensate for any fall in pressure in aseptic chamber 25.

What is claimed is:

1. A sterilizing unit for sterilizing a web of packaging material on a machine for packaging pourable food products, the sterilizing unit comprising:

a bath containing a sterilizing agent, in which said web is fed continuously;

an aseptic environment comprising a process chamber connected to an outlet of said bath and housing drying means for removing residual sterilizing agent from said web; and an aseptic chamber communicating with said process chamber via an opening for the passage of said web, and in which said web is folded and sealed longitudinally to form a tube which is filled continuously with the product for packaging; and an air processing circuit for controlling the process conditions in said aseptic environment, and comprising suction means for drawing air from said process chamber, air processing means, and means for feeding processed air into said aseptic chamber;

comprising valve means interposed between said process chamber and said suction means of said air processing circuit, and which can be activated during operation of said machine to control the pressure conditions in said aseptic environment.

2. A sterilizing unit as claimed in claim 1, comprising a transition chamber communicating with an inlet of the bath and with said suction means; said valve means being interposed between said process chamber and said transition chamber.

3. A sterilizing unit as claimed in claim 2, wherein said valve means comprise an orifice connecting said process chamber to said transition chamber; and a movable shutter for adjusting the opening of said orifice.

4. A sterilizing unit as claimed in claim 3, wherein the shutter is movable between an open position wherein said process chamber communicates directly with said transition chamber via said orifice, and a closed position wherein said process chamber communicates with said transition chamber via said bath when containing no sterilizing agent.

5. A sterilizing unit as claimed in claim 4, comprising sensor means for detecting the pressure in said aseptic environment; and adjusting means for adjusting said open position to maintain, in said aseptic environment, a pressure value at least equal to a predetermined threshold value.

6. A sterilizing unit as claimed in claim 2, comprising an orifice connecting said transition chamber to the outside environment; said orifice being normally closed, but being opened under low pressure.

7. A sterilizing unit as claimed in claim 1, comprising barrier means for producing a localized pressure drop between said aseptic chamber and said process chamber; said barrier means defining said opening, through which said web Is fed, between said process chamber and said aseptic chamber.

8. A sterilizing unit as claimed in claim 7, for processing a web of packaging material fitted with opening devices projecting from one face of said web; wherein said opening is asymmetrical with respect to the traveling plane of said web, and is higher on the side facing the face of said web from which said opening devices project.

9. A sterilizing unit as claimed in claim 8, comprising a guide roller located immediately downstream from said opening; said barrier means comprising a partition defining said opening and shaped to get close to said roller.

10. A sterilizing unit as claimed in claim 1, wherein said drying means comprise at least one nozzle for directing a jet of air on to said web; said means for feeding processed air into said aseptic environment comprising a first conduit for feeding air to an air inlet in said aseptic chamber, a second conduit for feeding air to said nozzle, and a distributor having an inlet connected to said air processing means, and two outlets connected respectively to said second conduit and to said first conduit.

11. A sterilizing unit as claimed in claim 10, comprising a heater housed in said second conduit.

* * * * *